US010074501B2

(12) United States Patent
Johnson

(10) Patent No.: US 10,074,501 B2
(45) Date of Patent: Sep. 11, 2018

(54) NON-ARCING FUSE

(71) Applicant: Littelfuse, Inc., Chicago, IL (US)

(72) Inventor: Brian Johnson, Saltash (GB)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 15/256,849

(22) Filed: Sep. 6, 2016

(65) Prior Publication Data

US 2018/0068820 A1 Mar. 8, 2018

(51) Int. Cl.

| | |
|---|---|
| ***H01H 85/38*** | (2006.01) |
| ***H01H 85/175*** | (2006.01) |
| ***H01H 85/143*** | (2006.01) |
| ***H01H 69/02*** | (2006.01) |

(52) U.S. Cl.

CPC ..... *H01H 85/38* (2013.01); *H01H 69/02* (2013.01); *H01H 85/143* (2013.01); *H01H 85/175* (2013.01)

(58) Field of Classification Search

CPC ..... H01H 85/38; H01H 69/02; H01H 85/143; H01H 85/175

USPC ..... 337/248

See application file for complete search history.

(56) References Cited

U.S. PATENT DOCUMENTS 2,300,142 A * 10/1942 Wood ..... H01H 85/36 337/164
3,678,430 A * 7/1972 Gaia ..... H01H 85/0458 337/159
3,701,069 A * 10/1972 Belcher ..... H01H 85/0458 337/160
3,909,765 A * 9/1975 Link ..... H01H 85/047 218/118
3,924,215 A * 12/1975 Allison ..... H01H 35/00 337/190
3,964,010 A * 6/1976 Tasuku ..... H01H 85/36 337/148
4,032,877 A * 6/1977 McAlister ..... H01H 37/761 337/148
4,041,435 A * 8/1977 Gaia ..... H01H 85/10 337/159
4,047,143 A * 9/1977 Burden ..... H01H 85/36 337/239
4,126,845 A * 11/1978 Iimori ..... H01H 37/766 337/408
4,313,099 A * 1/1982 Ackermann ..... H01H 85/18 218/90
4,321,574 A * 3/1982 Pertici ..... H01H 85/055 337/163

(Continued)

OTHER PUBLICATIONS

International Search Report and Written Opinion, dated Dec. 26, 2017, for International Application No. PCT/US17/50031 (9 pages).

*Primary Examiner* — Anatoly Vortman

(57) ABSTRACT

An arc-mitigating fuse including a tubular fuse body, a first endcap covering a first end of the fuse body and a second endcap covering a second end of the fuse body, a fusible element disposed within the fuse body and extending between the first endcap and the second endcap to provide an electrically conductive pathway therebetween, and an arc-mitigating element disposed within the fuse body and held in a compressed state between the first endcap and the second endcap, the arc-mitigating element adapted to extend to an uncompressed state upon separation of the fusible element.

10 Claims, 3 Drawing Sheets

(56) References Cited

U.S. PATENT DOCUMENTS

| | | | | | |
|---|---|---|---|---|---|
| 4,559,513 | A * | 12/1985 | Gaia | H01H 85/36 | 337/163 |
| 4,611,192 | A * | 9/1986 | Arora | H01H 85/055 | 337/163 |
| 4,652,964 | A * | 3/1987 | Ziegenbein | H02H 9/043 | 337/15 |
| 4,726,991 | A * | 2/1988 | Hyatt | H01B 7/2813 | 174/127 |
| 4,727,347 | A * | 2/1988 | Cambio | H01H 69/02 | 29/623 |
| 4,977,357 | A * | 12/1990 | Shrier | H01B 1/14 | 252/500 |
| 4,992,333 | A * | 2/1991 | Hyatt | H01C 7/105 | 338/20 |
| 6,232,866 | B1 * | 5/2001 | Javadi | H01C 7/1006 | 338/13 |
| 6,538,551 | B2 * | 3/2003 | Henricks | H01H 85/0052 | 337/161 |
| 7,132,697 | B2 * | 11/2006 | Weimer | B82Y 10/00 | 257/173 |
| 2003/0112117 | A1 * | 6/2003 | Miyashita | C22C 5/06 | 337/407 |
| 2012/0194315 | A1 | 8/2012 | Matthiesen et al. | | |
| 2015/0340188 | A1 | 11/2015 | Schmidt et al. | | |
| 2016/0141138 | A1 | 5/2016 | Schlaak et al. | | |

* cited by examiner

NON-ARCING FUSE

FIELD OF THE DISCLOSURE

The present disclosure relates generally to the field of circuit protection devices, and relates more particularly to a non-arcing fuse.

FIELD OF THE DISCLOSURE

Fuses are commonly used as circuit protection devices and are typically installed between a source of electrical power and a component in a circuit that is to be protected. One type of fuse, commonly referred to as "cartridge fuse" or "tube fuse," includes a fusible element disposed within a hollow, electrically insulating fuse body. Upon the occurrence of a specified fault condition, such as an overcurrent condition, the fusible element melts or otherwise opens to interrupt the flow of electrical current between the electrical power source and the protected component.

When the fusible element of a fuse is melted during an overcurrent condition, it is sometimes possible for an electrical arc to propagate between the separated portions of the fusible element. If not extinguished, this electrical arc may allow significant follow-on currents to flow to the protected component, resulting in damage to the component despite the physical opening of the fusible element. Thus, it is desirable to provide a fuse that effectively prevents or mitigates electrical arcing during overcurrent conditions.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An exemplary embodiment of an arc-mitigating fuse in accordance with the present disclosure may include a tubular fuse body, a first endcap covering a first end of the fuse body and a second endcap covering a second end of the fuse body, a fusible element disposed within the fuse body and extending between the first endcap and the second endcap to provide an electrically conductive pathway therebetween, and an arc-mitigating element disposed within the fuse body and held in a compressed state between the first endcap and the second endcap, the arc-mitigating element adapted to extend to an uncompressed state upon separation of the fusible element.

An exemplary embodiment of a method for manufacturing an arc-mitigating fuse in accordance with the present disclosure may include attaching a fusible element to a first endcap, securing an arc-mitigating element to the first endcap, placing a tubular fuse body over the fusible element and the arc-mitigating element with the first endcap covering a first end of the fuse body, placing a second endcap over a second end of the fuse body and in engagement with the arc-mitigating element, the fusible element extending through a hole in the second endcap, forcing the first end cap and the second end cap toward one another to compress the arc-mitigating element, and securing the fusible element to the second end cap to hold the arc-mitigating element in a compressed state.

DETAILED DESCRIPTION

Figure 1:
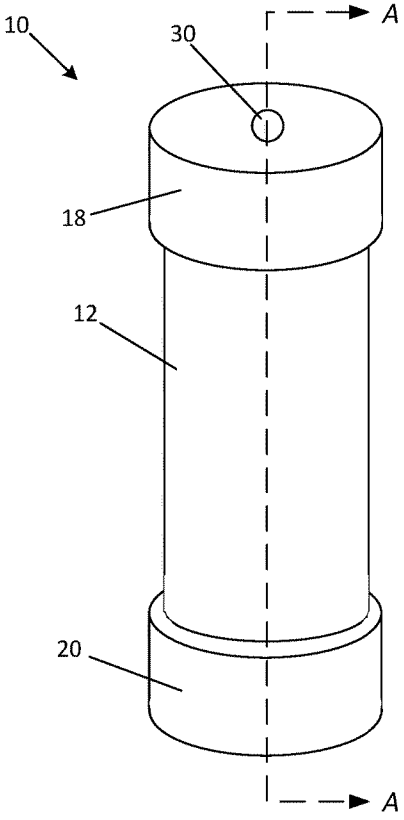
FIG. 1 is an isometric view illustrating an exemplary arc-mitigating fuse in accordance with the present disclosure.

Embodiments of a non-arcing fuse and a method for manufacturing the same in accordance with the present disclosure will now be described more fully with reference to the accompanying drawings, in which preferred embodiments of the present disclosure are presented. The non-arcing fuse and the accompanying method of the present disclosure may, however, be embodied in many different forms and should not be construed as being limited to the embodiments set forth herein. Rather, these embodiments are provided so that this disclosure will be thorough and complete, and will fully convey the scope of the non-arcing fuse and the accompanying method to those skilled in the art. In the drawings, like numbers refer to like elements throughout unless otherwise noted.

Figure 2B:
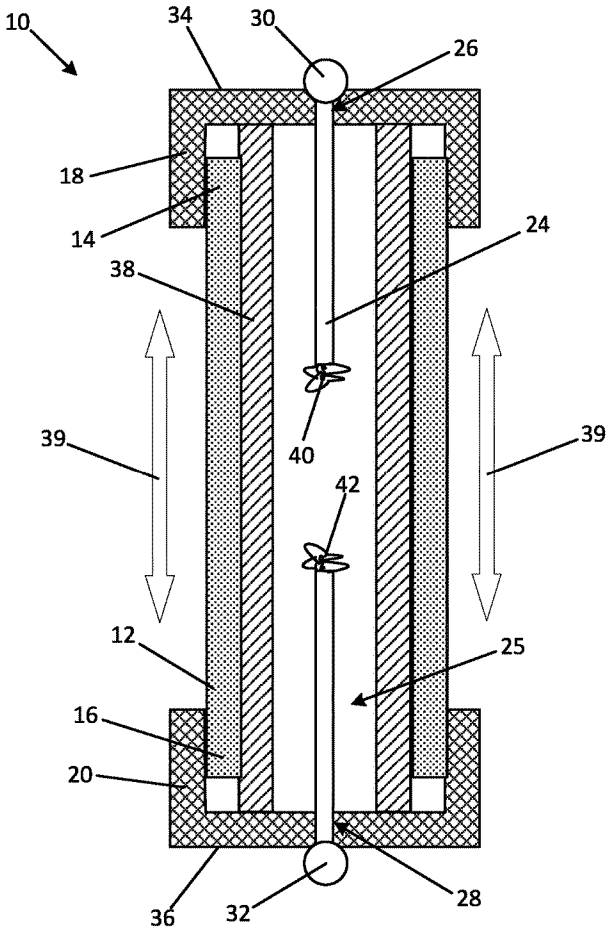
FIG. 2B is a cross section view taken along plane A-A in FIG. 1 illustrating an interior of the fuse when the arc-mitigating element of the fuse is in an uncompressed.

Referring to FIGS. 1-2B, respective isometric and cross-sectional views of a non-arcing fuse 10 (hereinafter "the fuse 10") in accordance with an exemplary embodiment of the present disclosure are shown. The fuse 10 may include a tubular fuse body 12 having opposing open ends 14, 16. The fuse body 12 may be a round cylinder as shown in FIG. 1, but this is not critical. Alternative embodiments of the fuse 10 may have a fuse body that is a square cylinder, an oval cylinder, a triangular cylinder, etc.

Figure 2A:
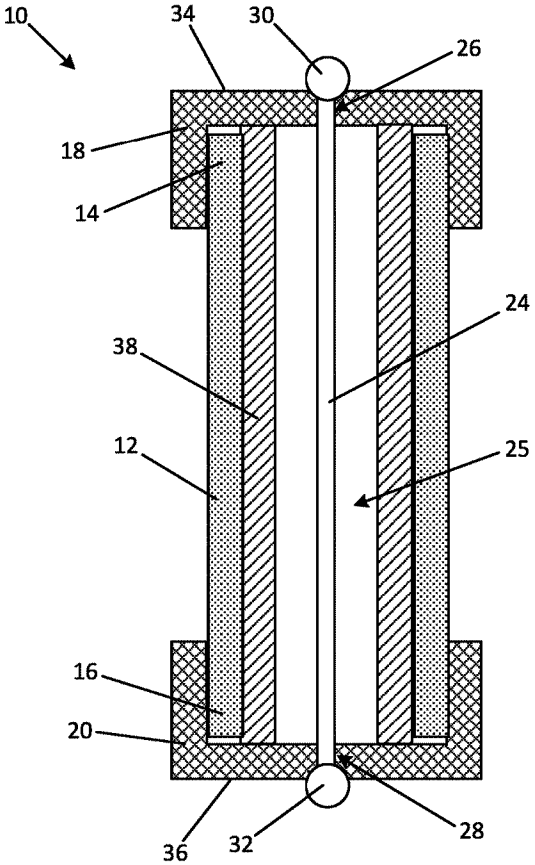
FIG. 2A is a cross sectional view taken along plane A-A in FIG. 1 illustrating an interior of the arc-mitigating fuse when an arc-mitigating element of the fuse is in a compressed state.

Referring to FIG. 2A, a pair of conductive endcaps 18, 20 may fit over the ends 14, 16 of the fuse body 12, respectively. A fusible element 24 (e.g., a fuse wire) may extend through the hollow interior 25 of the fuse body 12 and through holes 26, 28 formed in the endcaps 18, 20, respectively. The ends of the fusible element 24 may be secured to the endcaps 18, 20 in electrical communication therewith, such as by quantities of solder 30, 32 applied to the ends of the fusible element 24 and to the exterior faces 34, 36 of the endcaps 18, 20. Alternatively or additionally, one or both of the ends of the fusible element 24 may be soldered to the interior surfaces of the endcaps 18, 20.

The fuse body 12 of the fuse 10 may be formed of an electrically insulating and preferably heat resistant material, including, but not limited to, ceramic or glass. The endcaps 18, 20 may be formed of an electrically conductive material, including, but not limited to, copper or one of its alloys, and may be plated with nickel or other conductive, corrosion resistant coatings. The fusible element 24 may be formed of an electrically conductive material, including, but not limited to, tin or copper, and may be configured to melt and separate upon the occurrence of a predetermined fault condition, such as an overcurrent condition in which an amount of current exceeding a predefined maximum current flows through the fusible element 24.

The fuse 10 may further include an arc-mitigating element 38 disposed within the fuse body 12 and extending between the endcaps 18, 20. The arc-mitigating element 38 may be formed of a quantum tunneling compound (QTC). As will be familiar to those of ordinary skill in the art, QTCs are typically resilient rubber compounds that are loaded with particles of electrically conductive materials, which may include, but are not limited to, silver and nickel. When a QTC is in a natural, uncompressed state, the conductive particles within the QTC are relatively far apart from one another and the electrical resistance of the QTC is relatively high. However, when a QTC is compressed, the conductive particles within the QTC are moved relatively closer to one another and the electrical resistance of the QTC is therefore relatively lower than in the uncompressed state. The arc-mitigating element 38 may be a generally tubular body that radially surrounds the fusible element 24 as shown in FIGS. 2A and 2B, but this is not critical. It is contemplated that the arc-mitigating element 38 may have various other form factors that are adapted to extend between the endcaps 18, 20 and that can be axially compressed and expanded between the endcaps 18, 20 as further described below.

The arc-mitigating element 38 may be secured to the endcaps 18, 20 in electrical communication therewith, such as by electrically conductive epoxy, solder, mechanical fasteners, etc. However, at least one of the endcaps 18, 20 is not secured to the fuse body 12. Thus, at least one of the endcaps 18, 20 is free to move axially relative to the fuse body 12 as described in greater detail below.

In the assembled fuse 10, the arc-mitigating element 38 may be held in axial compression between the endcaps 18, 20 by the fusible element 24 as shown in FIG. 2A. That is, the arc-mitigating element 38, which is axially longer than the fuse body 12 in an uncompressed state, may be axially compressed and may be held in compression by the fusible element 24 and the attached endcaps 18, 20. The arc-mitigating element 38 may, in its compressed state, exhibit a first electrical resistance $R_1$ and may provide an electrically conductive pathway between the endcaps 18, 20 that is in parallel with the electrically conductive pathway provided by the fusible element 24. In one non-limiting example, the first electrical resistance $R_1$ may be in a range between about 1 ohm and about 20 ohms. Thus, during normal operation of the fuse 10, electrical current may flow between the endcaps 18, 20 through both the fusible element 24 and the and the arc-mitigating element 38. The amount of current that flows through the arc-mitigating element 38 will depend on numerous factors, including the resistance $R_1$ of the arc-mitigating element 38 in its compressed state relative to the resistance of the fusible element 24.

Upon the occurrence of an overcurrent condition in the fuse 10, the fusible element 24 may melt and separate as shown in FIG. 2B. Since the endcaps 18, 20 are no longer connected by the fusible element 24, the arc-mitigating element 38 is no longer held in axial compression between the endcaps 18, 20 and is allowed to expand to its uncompressed length, thereby pushing the endcaps 18, 20 away from one another as indicated by the arrows 39. Since the endcaps 18, 20 are secured to the arc-mitigating element 38, and since at least one of the endcaps 18, 20 is not secured to the fuse body 12 (as described above), at least one of the endcaps 18, 20 is free to move relative to the fuse body 12 while remaining in electrical contact with the arc-mitigating element 38. As the arc-mitigating element 38 expends from the compressed state shown in FIG. 2A to the uncompressed state shown in FIG. 2B, the electrical resistance of the arc-mitigating element 38 may quickly increase from the first electrical resistance $R_1$ to a second electrical resistance $R_2$. The second electrical resistance $R_2$ may be sufficient to completely arrest the flow of current between the endcaps 18, 20, or may allow some nominal amount of current to flow between the endcaps 18, 20. In one non-limiting example, the second electrical resistance $R_2$ may be in a range between about 1 mega ohm and about 100 mega ohms.

Since a nominal amount of current is allowed to flow through the arc-mitigating element 38 as it expands from its compressed state to its uncompressed state and as its electrical resistance increases from $R_1$ to $R_2$, voltage build-up between the separated ends 40, 42 of the fusible element 24 is minimized or eliminated and the likelihood of electrical arcing between the separated ends 40, 42 is thereby mitigated. The nominal current that flows through the arc-mitigating element 38 after separation of the fusible element 24 is substantially dissipated as heat. Thus, the total effect of the expansion of the arc-mitigating element 38 is that electrical arcing within the fuse 10 is mitigated and significant follow-on currents that could otherwise damage protected devices connected to the fuse 10 are prevented.

Figure 3:
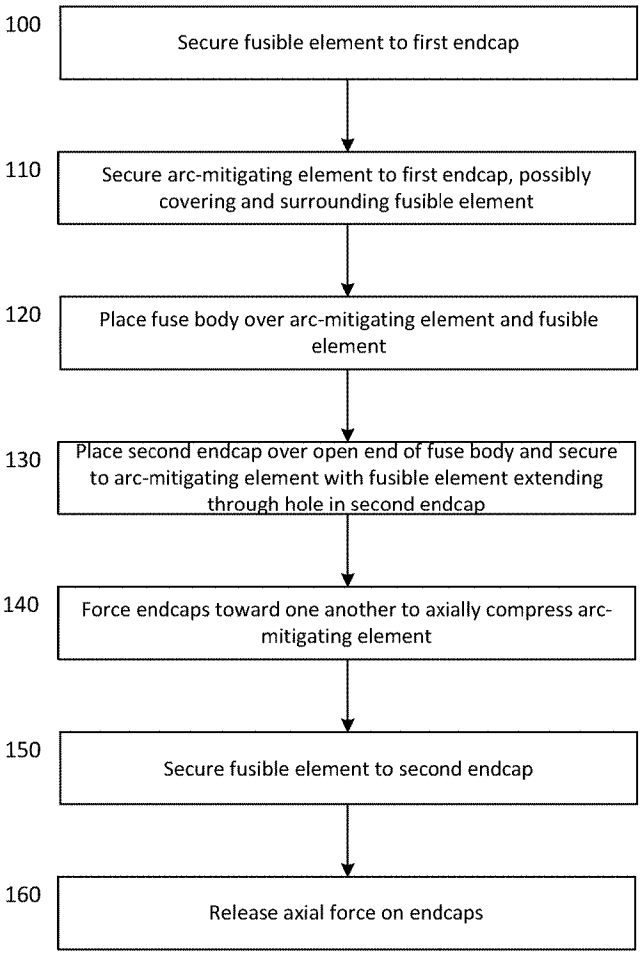
FIG. 3 is a flow diagram illustrating an exemplary method of manufacturing the arc-mitigating fuse shown in FIGS. 1-2B in accordance with the present disclosure.

Referring to FIG. 3, a flow diagram illustrating an exemplary method for manufacturing the fuse 10 in accordance with the present disclosure is shown. The method will now be described in conjunction with the illustrations of the fuse 10 shown in FIGS. 1-2B.

At step 100 of the exemplary method, the fusible element 24 may be secured to the endcap 20 in electrical communication therewith, such as by a quantity of solder 32 or other electrically conductive means of affixation (e.g., welding, conductive adhesive, etc.). In one non-limiting example, an end of the fusible element 24 may be extended through the hole 28 in the endcap 20 and may be soldered to the exterior face 36 of the endcap 20 as shown in FIG. 2A. Alternatively, or additionally, the end of the fusible element 24 may be soldered to the interior surface of the endcap 20.

At step 110 of the exemplary method, the arc-mitigating element 38 may be secured to the endcap 20 in electrical communication therewith, such as by solder, conductive adhesive, etc. In the embodiment of the fuse 10 shown in FIG. 2A, wherein the arc-mitigating element 38 is tubular, this may involve placing the arc-mitigating element 38 over the fusible element 24 with the fusible element 24 extending axially through the arc-mitigating element 38.

At step 120 of the exemplary method, the fuse body 12 may be placed over the arc-mitigating element 38 and the fusible element 24 with the open end 16 of the fuse body 12 disposed adjacent the endcap 20 and with the arc-mitigating element 38 and the fusible element 24 extending axially through the fuse body 12. At step 130, the endcap 18 may be placed over the open end 14 of the fuse body 12 and may be secured to the arc-mitigating element 38 in electrical communication therewith, such as by solder, conductive adhesive, etc., with an end of the fusible element 24 extending through the hole 26 in the endcap 18.

At step 140 of the exemplary method, the arc-mitigating element 38 may be axially compressed, such as by the application of axial force on the endcaps 18, 20 toward one another, with the rigid fuse body 12 acting as a limit or hard stop. While the arc-mitigating element 38 is held in axial compression, the end of the fusible element 24 may, at step 150 of the method, be secured to the endcap 18 in electrical communication therewith, such as by a quantity of solder 30 or other electrically conductive means of affixation (e.g., welding, conductive adhesive, etc.). In one non-limiting example, the solder 30 may be applied to the exterior face 34 of the endcap 18 as shown in FIG. 2A. With the fusible element 24 secured to both of the endcaps 18, 20, the axial force that was applied to the endcaps 18, 20 in step 140 to compress the arc-mitigating element 38 can, at step 160 of the method, be released. The fusible element 24 will hold the endcaps 18, 20 at a fixed distance relative to one another at which the endcaps 18, 20 continue to hold the arc-mitigating element 38 in axial compression.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. An arc-mitigating fuse comprising:

a tubular fuse body;

a first endcap covering a first end of the fuse body and a second endcap covering a second end of the fuse body;

a fusible element disposed within the fuse body and extending between the first endcap and the second endcap to provide an electrically conductive pathway therebetween; and an arc-mitigating element disposed within the fuse body and held in a compressed state between the first endcap and the second endcap, the arc-mitigating element adapted to extend to an uncompressed state upon separation of the fusible element, the arc-mitigating element providing a first electrically conductive pathway extending from the first end cap to the second endcap, and the fusible element providing a second electrically conductive pathway extending from the first end cap to the second endcap, the first and second electrically conductive pathways being electrically in parallel with one another and being electrically independent and separate from one another.

2. The arc-mitigating fuse of claim 1, wherein the arc-mitigating element exhibits a first electrical resistance in the compressed state and a second electrical resistance in the uncompressed state, the second electrical resistance being greater than the first electrical resistance.

3. The arc-mitigating fuse of claim 2, wherein the first electrical resistance is in a range between 1 ohm and 20 ohms and the second electrical resistance is in a range between 1 mega ohm and 100 mega ohms.

4. The arc-mitigating fuse of claim 1, wherein the arc-mitigating element is formed of a quantum tunneling compound.

5. The arc-mitigating fuse of claim 1, wherein the arc-mitigating element is a tubular member having an uncompressed length that is greater than a length of the fusible element.

6. The arc-mitigating fuse of claim 1, wherein the arc-mitigating element biases the first endcap and the second endcap away from one another to hold the fusible element in tension.

7. The arc-mitigating fuse of claim 1, wherein one of the first endcap and the second endcap is fastened to the fuse body.

8. The arc-mitigating fuse of claim 1, wherein one of the first endcap and the second endcap is fastened to the arc-mitigating element in electrical communication therewith.

9. The arc-mitigating fuse of claim 1, wherein the first endcap and the second endcap are fastened to the arc-mitigating element in electrical communication therewith.

10. The arc-mitigating fuse of claim 1, wherein the fusible element is rigidly secured to the first endcap and to the second endcap to retain the arc-mitigating element in the compressed state.

* * * * *